US005301493A

United States Patent [19]

Chen

[11] Patent Number: 5,301,493

[45] Date of Patent: Apr. 12, 1994

[54] STEPLESSLY ADJUSTABLE PRE-STRETCHED FILM WRAPPING APPARATUS

[76] Inventor: Tsung-Yen Chen, No. 2, Lane 31, Chung-Hsing Road, Hsichih Cheng, Taipei Hsien, Taiwan

[21] Appl. No.: 951,240

[22] Filed: Sep. 25, 1992

[51] Int. Cl.[5] ..... B65B 11/04

[52] U.S. Cl. ..... 53/556; 53/588; 53/587

[58] Field of Search ..... 53/399, 441, 587, 556, 53/588; 74/194

[56] References Cited

U.S. PATENT DOCUMENTS

| | | | |
|---|---|---|---|
| 1,994,772 | 3/1935 | Landriani | 74/194 X |
| 2,434,497 | 1/1948 | Kearsley | 74/194 X |
| 2,460,863 | 2/1949 | Weiss | 74/194 X |
| 3,097,539 | 7/1963 | Opocensky | 74/194 X |
| 4,047,442 | 9/1977 | Pammer | 74/194 |
| 4,302,920 | 12/1981 | Lancaster | 53/556 X |
| 4,387,552 | 6/1983 | Lancaster | 53/556 |
| 4,458,467 | 7/1984 | Shulman | 53/556 X |
| 4,514,955 | 5/1985 | Mouser | 53/556 |
| 4,628,668 | 12/1986 | Wildmoser | 53/556 X |
| 4,706,443 | 11/1987 | Humphrey | 53/556 |
| 5,081,824 | 1/1992 | Thimon | 53/556 |

FOREIGN PATENT DOCUMENTS

| | | | |
|---|---|---|---|
| 144266 | 6/1985 | European Pat. Off. | 53/556 |
| 2579577 | 10/1986 | France | 53/556 |

*Primary Examiner*—John Sipos

*Attorney, Agent, or Firm*—Poms, Smith, Lande & Rose

[57] ABSTRACT

A steplessly adjustable pre-stretched film wrapping apparatus comprises a downstream film roller and an upstream film roller connected therebetween with an adjustable power transmission system to unwind and stretch a film web from a film roll. The power transmission system comprises a motor generating a rotational motion to drive a main shaft. A pair of mating bevel gears are used to transmit the rotation to the downstream film roller and a disk member which is secured on the upstream film roller and is driven by the main shaft via an active roller coaxially rotatable with the main shaft and an idle roller interposed between the active roller and the disk member to rotate the upstream film roller. The idle roller is contactingly rolling on a side of the disk member to be rotatably in an orthogonal way and thus defining a distance from the center of the disk member which determines the speed ratio therebetween. A linear motion actuation motor is provided to move the idle roller on the disk member to change the distance from the disk member center so as to adjust the speed ratio. Two idle rollers are respectively disposed between the upstream film roller and the film roll and the downstream film roller and a load to be wrapped to maintain the angular relationship of the film around the film rollers constant. .

2 Claims, 4 Drawing Sheets

STEPLESSLY ADJUSTABLE PRE-STRETCHED FILM WRAPPING APPARATUS

FIELD OF THE INVENTION

The present invention relates generally to a palletized package load wrapping apparatus and in particular to a wrapping apparatus which applies a pre-stretched film web in a steplessly adjustable way to over-wrap the palletized load.

BACKGROUND OF THE INVENTION

In the past, apparatus have been widely used in providing a unitary package by using a stretched film web to over-wrap a load on a pallet to facilitate long distance or overseas transportation of the palletized packages One of the early types of wrapping apparatus for this purpose is shown in FIG. 3 of the attached drawings, wherein a roll of stretchable film is rotatably disposed with respect to a turntable on which the palletized load is placed so that when the turntable rotates, the film is unwound from the film roll and over-wrapping around the palletized load.

One of the disadvantages of this early type wrapping apparatus is that if the palletized load is rectangular in shape, then the linear speed of the unwound film is unstable owing to the existence of corners of the rectangular load and thus necking or shrinking in lateral dimension may occur during wrapping the load. This may induce a damage to the film web and thus resulting in a poor wrapping.

To address the problem, a later type of stretch wrapping apparatus was developed. The later type apparatus, as shown in FIG. 4, comprises a pair of rollers, an upstream roller and a downstream roller, rotating at different speeds to stretch the film web at a pre-determined amount. Examples of this type of wrapping apparatus are U.S. Pat. Nos. 4,302,920 and 4,387,552.

A disadvantage of this later type wrapping apparatus is that since the rollers are driven by inter-engaged gears, the speed ratio between these two rollers is in generally not adjustable or its adjustment is very limited to certain discrete values. If wrapping with a different degree of stretching is required, the unadjustability of the speed ratio will prevent the wrapping apparatus from wrapping the load with an appropriately-stretched film.

Furthermore, since the diameter of the film roll is decreasing with the consumption of the film, the angle between one of the rollers and the film roll is constantly changed. Similarly, when a rectangular load is wrapped, the angle between the other roller and the load varies from time to time owing to the corners of the rectangular load.

It is therefore desirable to provide a stretch wrapping apparatus which comprises a steplessly adjustable means between the high speed (downstream) roller and the low speed (upstream) roller to provide a stepless speed ratio variation means therebetween.

OBJECTS OF THE INVENTION

It is the principle object of the present invention to provide a steplessly adjustable pre-stretched film wrapping apparatus which comprises a steplessly adjustable means interconnected between the downstream roller and the upstream roller to provide a stepless speed ratio variation therebetween so as to provide a wrapping apparatus which is applicable to palletized load wrapping operations which require different degrees of stretching of the film web.

It is also an object of the present invention to provide a stretch wrapping apparatus which has an upstream idle roller disposed between the upstream roller and the film roll and a downstream idle roller disposed between the downstream roller and the palletized load to be wrapped to provide substantially constant angular relationships with respect to the rollers as the film winds around both the upstream and downstream rollers.

To achieve the above-mentioned object, there is provided a steplessly adjustable pre-stretched film wrapping apparatus comprises a downstream film roller and an upstream film roller connected therebetween with an adjustable power transmission system to unwind and stretch a film web from a film roll. The power transmission system comprises a motor generating a rotational motion to drive a main shaft. A pair of mating bevel gears are used to transmit the rotation to the downstream film roller and a disk member which is secured on the upstream film roller and is driven by the main shaft via an active roller coaxially rotatable with the main shaft and an idle roller interposed between the active roller and the disk member to rotate the upstream film roller. The idle roller is contactingly rolling on a side of the disk member to be rotatably in an orthogonal way and thus defining a distance from the center of the disk member which determines the speed ratio therebetween. A linear motion actuation motor is provided to move the idle roller on the disk member to change the distance from the disk member center so as to adjust the speed ratio Two idle rollers are respectively disposed between the upstream film roller and the film roll and the downstream film roller and a load to be wrapped to maintain constant angular relationships of the film around the film rollers.

Other objects and advantages of the invention will be apparent from the following description of a preferred embodiment taken in connection with the attached drawings, in which:

DETAILED DESCRIPTION OF THE PREFERRED EMBODIMENT

Figure 1:
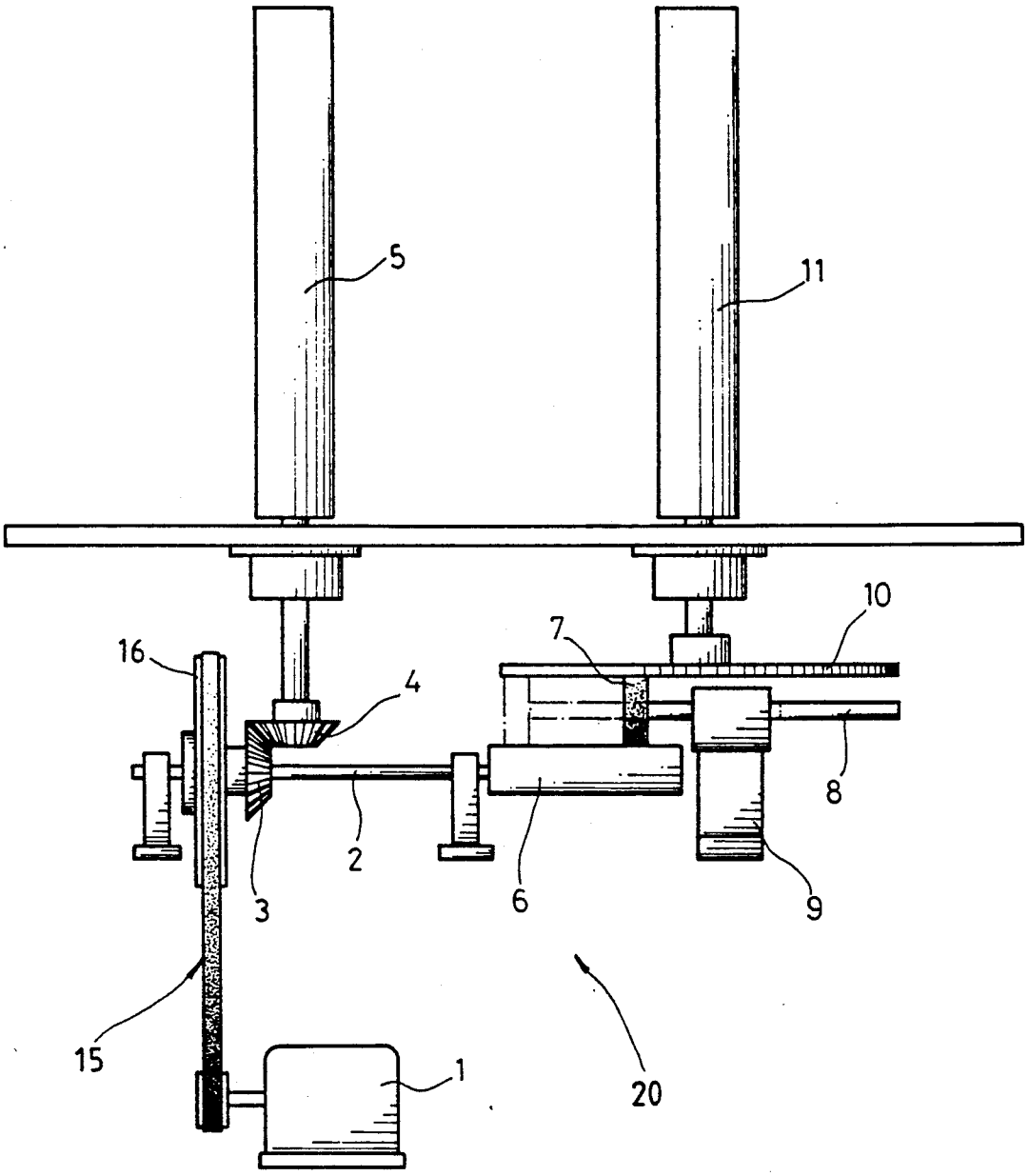
FIG. 1 is a side elevational view showing a steplessly adjustable pre stretched film wrapping apparatus in accordance with the present invention.
Figure 2:
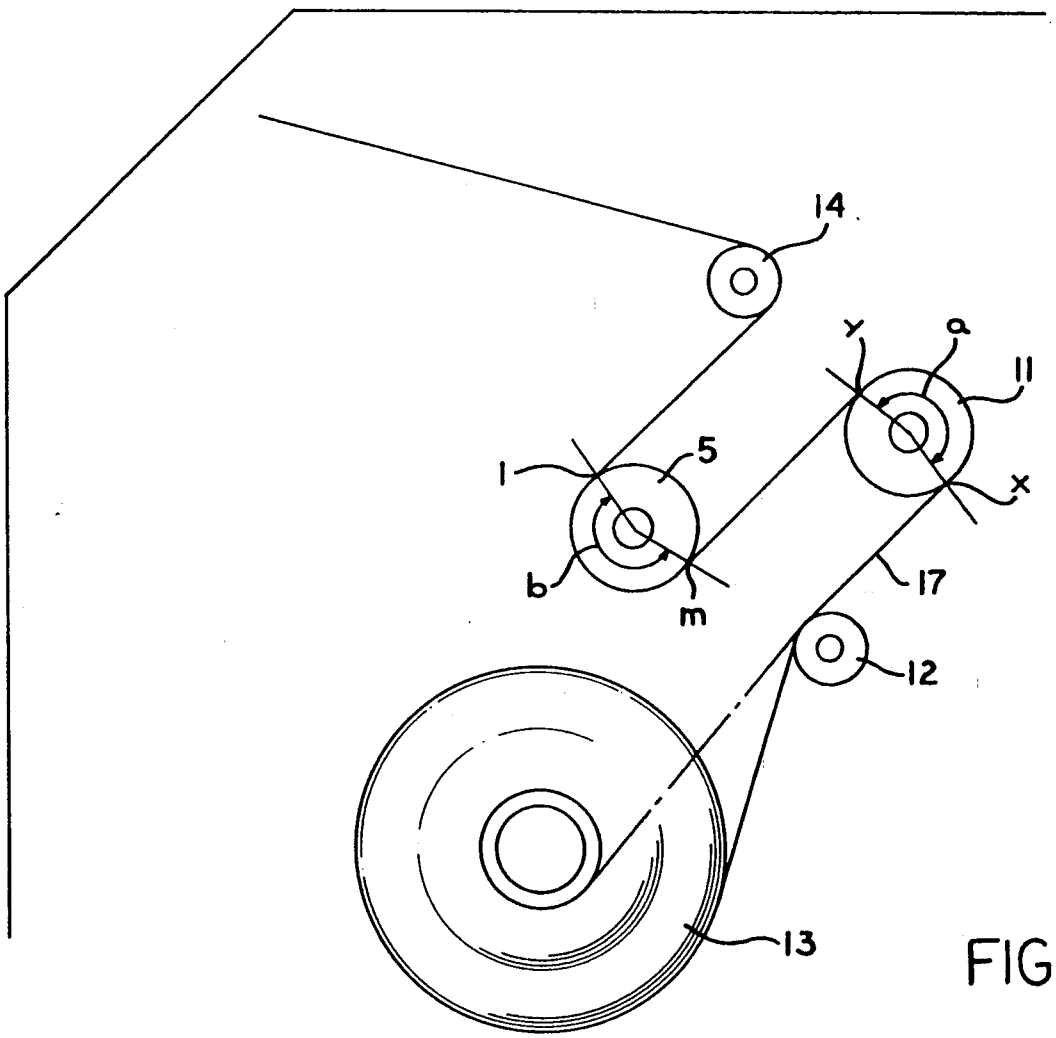
FIG. 2 is a top plane view showing the arrangement of the idle rollers with respect to the main film rollers of the stretch wrapping apparatus shown in FIG. 1.
Figure 3:
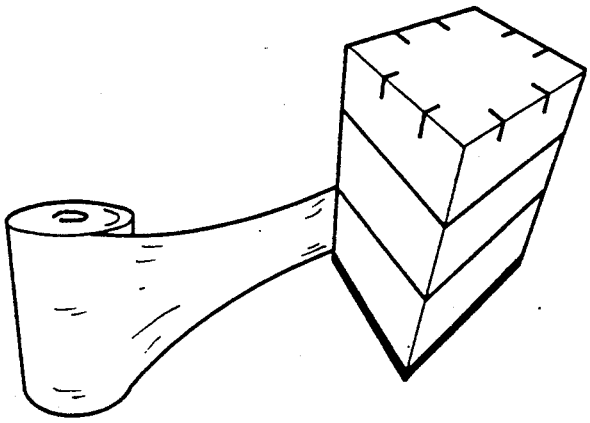
FIG. 3 PRIOR ART
FIG. 3 is a perspective view showing the wrapping of a palletized load with an early type prior art stretch wrapping apparatus.
Figure 4:
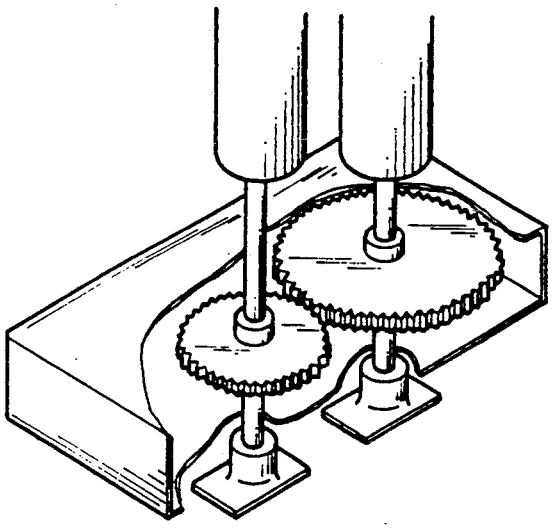
FIG. 4 PRIOR ART
FIG. 4 is a perspective view, with a portion thereof partially broken, showing the structure of a later type prior art stretch wrapping apparatus.

With reference to the drawings and in particular to FIGS. 1 and 2 wherein a stretch wrapping apparatus of the present invention is shown, the stretch wrapping apparatus of the present invention comprises a high speed downstream film roller 5 and a lower speed upstream film roller 11 mechanically connected with an adjustable power transmission system 20. A film web 17 unwound from a film roll 13 extends between the upstream film roller 11 and the downstream film roller 5 to be stretched therebetween before the film web 17 is applied to a load (not shown).

The adjustable power transmission system 20 comprises a motor 1 serving as a power source which generates rotational motion and transmits the rotational motion to a main power shaft 2 via a belt and pulley system 15. The main power shaft 2 is secured on a pulley 16 of the belt and pulley system 15 to be driven thereby and thus rotatable about a longitudinal axis thereof.

A first bevel gear 3 is mounted on the main power shaft 2 to rotate therewith. The first bevel gear 3 engages with a second bevel gear 4 which is secured on a shaft of the downstream film roller 5 and thus transmitting the rotational motion thereto. The downstream film roller shaft has a rotational axis substantially normal to the axis of the main power shaft 2 so as to rotate in a direction normal to that of the main power shaft 2.

A cylindrical member 6 is coaxially mounted on the main power shaft 2 to rotate therewith about the longitudinal axis thereof. A disk-like member 10 which is mounted on a shaft of the upstream roller 11 with a central axis thereof collinear with a rotational axis of the upstream roller 11 to be rotatable therewith. The central axis of the disk member 10 is substantially normal to the longitudinal axis of the main power shaft 2. An idle roller 7, which is secured on a rotationally supported shaft 8 to guide the rolling motion thereof, is interposed between the disk member 10 and the cylindrical member 6 with a rotational axis thereof substantially parallel with the longitudinal axis of the main power shaft 2 and normal to the central axis of the disk member 10. The idle roller 7 frictionally contactingly engages with the cylindrical member 6 to be rotatable therewith in a reversed direction. The idle roller 7 frictionally contactingly rolls on a side surface of the disk member 10 with a suitable distance between the contact point and the center of the disk member 10 so as to transmit the rotational motion from the cylindrical member 6 to the disk like member 10.

The distance between the contact point and the center of the disk member 10 determines the speed ratio between the idle roller 7 and the disk member 10 and since the speed ratio between the cylindrical member 6 and the idle roller 7 is constant, the distance also determines the ratio between the cylindrical rolling member 6 and the disk member 10 and thus determining the speed ratio between the main power shaft 2 and the upstream film roller 11.

The idle roller 7 is provided with a linear motion actuation means 9, such as a motor with gears and racks thereon, which linearly moves the idle roller 7 via the shaft 8 along the rotational axis thereof. Since the rotational axis of the idle roller 7 is parallel with that of the cylindrical member 6, the linear movement of the idle roller 7 will not change the relationship therebetween while the distance between the idle roller 7 and the center of the disk member 10 change with the linear motion of the idle roller 7 and thus changing the speed ratio therebetween.

Since the linear movement of the idle roller 7 along the rotational axis thereof can be controlled by the motor 9 in a stepless way, the speed ratio between the main power shaft 2 and the upstream film roller 11 and thus the speed ratio between the downstream film roller 5 and the up stream film roller 11 is steplessly adjustable.

To maintain the film web 17 unwound from the film roll 13 in contact with both the upstream and downstream film rollers 11 and 5 with constant angular relationship, an upstream idle roller 12 is provided between the upstream film roller 11 and the film roll 13 to guide the motion of the unwound film in such a manner that the film maintains a constant angle with the upstream film roller 11 and thus maintaining the angular relationship thereof around the upstream film roller 11 is a constant value. Similarly, a downstream idle roller 14 is disposed between the downstream film roller 5 and the load (not shown) to be wrapped for the same purpose. preferably, the upstream idle roller 12 and the downstream idle roller 14 are disposed in such a way to maintain the wrapping angular relationship of the unwound film 17 around both the upstream and downstream film rollers 11 and 5 constant. That is, the idle roller 12, abutting against film web 17, maintains the tangent point x (see FIG. 2) of contact of web 17 with film roll 11 at the same tangent point throughout the unwinding of film from roll 13. This tangent point x makes an angle a formed by an imaginary line extending from point x to the center of roll 11 along with an imaginary line extending from point y (the tangent point where film web 17 leaves roll 11) to the center of roll 11, as seen in FIG. 2.

The idle roller 14, abutting against film web 17, maintains the tangent point l of contact of web 17 with film rill 5 at the same tangent point throughout the unwinding of film from roll 5. This tangent point l makes an angle b formed by an imaginary line extending from point l to the center roll 5 along with an imaginary line extending from point m (the tangent point where film web 17 from roll 11 contacts roll 5) to the center or roll 5, as seen in FIG. 2. Thus, the idle rollers 12 and 14 cooperate to maintain the angles a and b constant as the film web 17 unwinds from roll 13. As seen in FIG. 2, these angles a and b are about 180°.

It is apparent that although the invention has been described in connection with a preferred embodiment, those skilled in the art may make changes to certain features of the preferred embodiment without departing from the spirit and scope of the invention as defined in the appended claims.

What is claimed is:

1. A steplessly adjustable pre-stretched film wrapping apparatus comprising an upstream film roller rotatable with a second rotational speed with a film web unwound from a film roll extending therebetween and partially wrapping around said upstream and downstream film rollers to be stretched thereby, a first motor being provided to generate a rotational motion which is transmitted to a main shaft via a mechanical transmission system, a first mechanical connection being provided between said main shaft and said downstream film roller to transmit the rotational motion to said downstream film roller to provide said downstream film roller with said first rotational speed, a second mechanical connection being provided between said main shaft and said upstream film roller to transmit the rotational motion to said upstream film roller to provide said upstream film roller with said second rotational speed, said second mechanical connection comprising an input member which is rotatable with said main shaft and an output member which is rotatable with said upstream film roller, an adjusting member being interposed between said input member and said output member to transmit the rotational motion from said input member to said output member in an adjustable way so as to adjust a speed ratio therebetween and thus changing a ratio between said first rotational speed and said second rotational speed, said input member of said second mechanical connection being a cylindrical member coaxially mounted on said main shaft to be rotatable about a longitudinal axis of said main shaft and wherein said output member of said second mechanical connection is a disk member with a center thereof connected to a shaft of said upstream film roller to be rotatable with said upstream film roller about a central axis thereof, said central axis being substantially normal to said longitudinal axis, and wherein said adjusting member is an idle roller frictionally contractingly interposed between said disk member and cylindrical member, said idle roller having a rotational axis substantially parallel with said longitudinal axis so that a constant speed ratio between said cylindrical member and said idle roller is maintained, said idle roller being rolling on a side surface of said disk at a location with distance from the center of said disk member so as to transmit the rotational motion to said disk member, said adjusting member being provided with a linear motion actuation means to move said idle roller along the rotational axis thereof to change said distance from the center of said disk member so as to drive said disk member at different speed and thus adjusting the speed ratio therebetween.

2. An apparatus as claimed in claim 1 wherein said idle roller is rotationally supported by a shaft extending along the rotational axis thereof and wherein said linear motion actuation means comprises a second motor with a mechanical transmission system thereon to drive said shaft of the idle roller along said rotational axis of the idle roller.

* * * * *